United States Patent [19]

Nab

[11] 4,294,024

[45] Oct. 13, 1981

[54] SOLE FOR LOGGING BOOT

[76] Inventor: Joseph J. Nab, 265 Orange St., Ashland, Oreg. 97520

[21] Appl. No.: 946,342

[22] Filed: Sep. 27, 1978

[51] Int. Cl.[3] ..... A43B 3/00; A43C 15/00

[52] U.S. Cl. ..... 36/113; 36/67 D

[58] Field of Search ..... 36/59 R, 67 R, 67 D, 36/113

[56] References Cited

U.S. PATENT DOCUMENTS

| | | | |
|---|---|---|---|
| 1,246,929 | 11/1917 | Jasper | 36/59 R |
| 2,108,439 | 2/1938 | L'Hollier | 36/59 R |
| 3,597,863 | 8/1971 | Austin | 36/59 R |
| 3,793,750 | 2/1974 | Bowerman | 36/59 C |
| 4,098,011 | 7/1978 | Bowerman et al. | 36/59 R |

FOREIGN PATENT DOCUMENTS

| | | | |
|---|---|---|---|
| 239944 | 11/1945 | Switzerland | 36/59 R |

*Primary Examiner*—Patrick D. Lawson

*Attorney, Agent, or Firm*—Klarquist, Sparkman, Campbell, Leigh, Whinston and Dellett

[57] ABSTRACT

A one-piece outer sole for logging boots is described which includes pointed metal calks received by receptacles in portions of the outersole which are located beneath the ball, arch and heel portions of the wearer's foot. The sole is made of a flexible material; and the receptacles beneath the ball portion of the wearer's foot are aligned in multiple rows each of which is parallel to a line through the metatarsal phalangeal joints of the wearer's foot. The rows are spaced apart a sufficient distance that an uninterrupted, straight, lateral area of the outersole extends between adjacent rows so that the portion of the outersole beneath the ball portion of the wearer's foot is longitudinally flexible along an axis which is normal to the rows.

17 Claims, 5 Drawing Figures

FIG.4
FIG.1
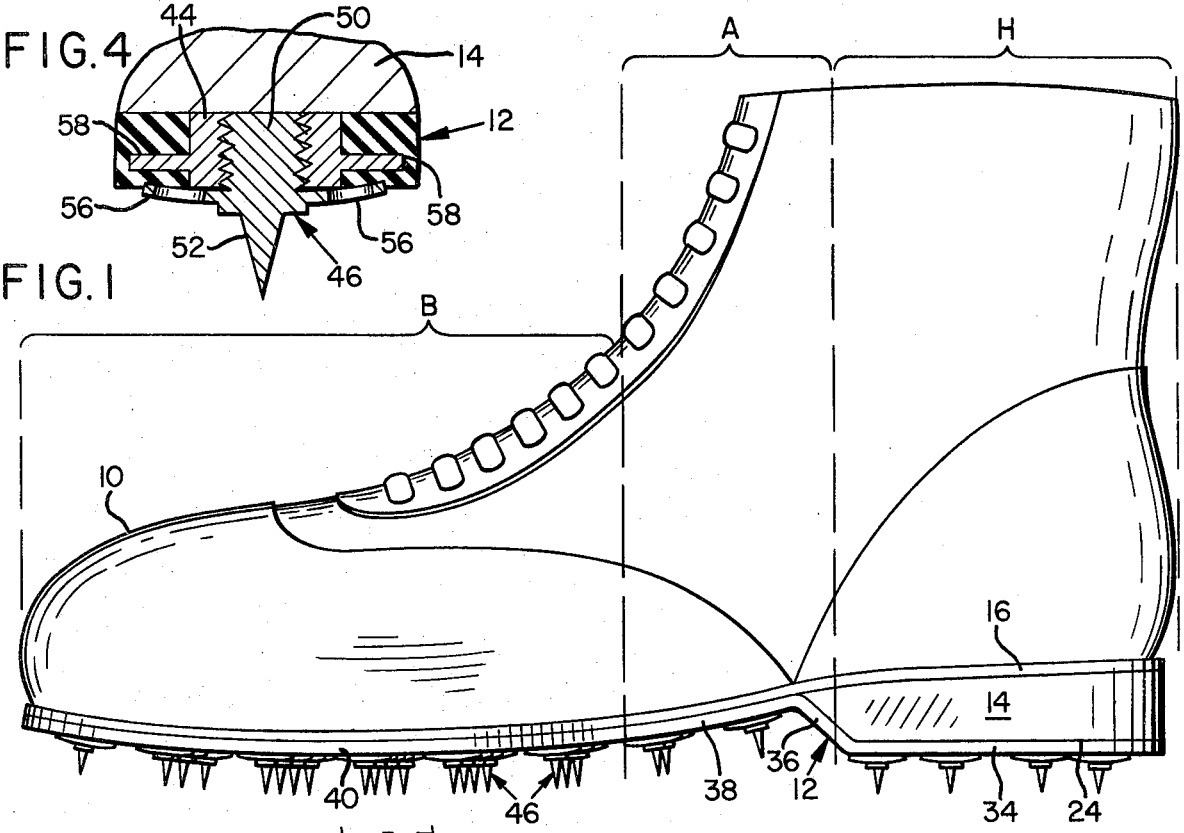
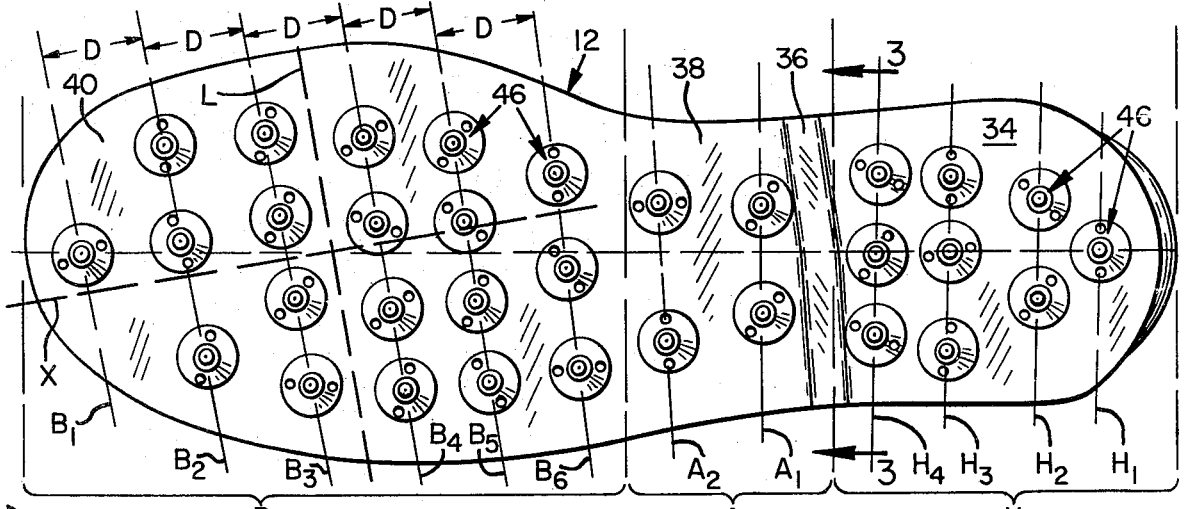
FIG.2
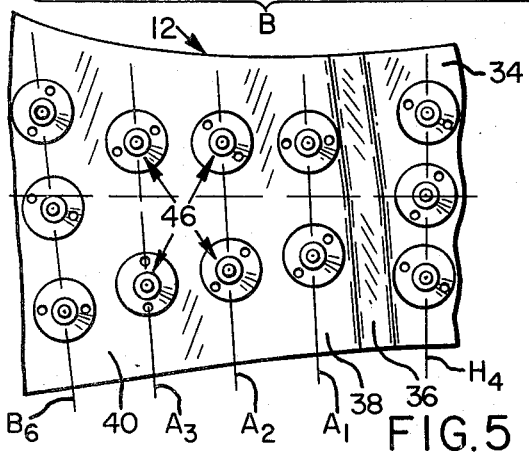
FIG.5
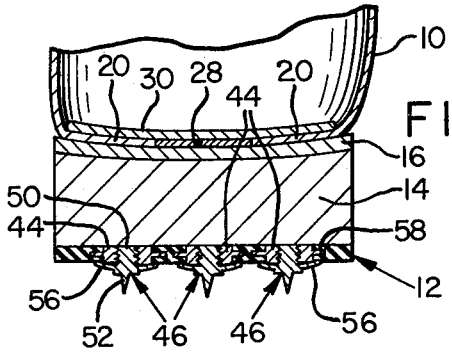
FIG.3

SOLE FOR LOGGING BOOT

BACKGROUND OF THE INVENTION

The present invention relates generally to work boots having calked soles and in particular to such boots having replaceable metal calks.

For safety, work boots used for logging and other similar activities include numerous pointed metal calks which extend from all downwardly facing surfaces of the boot's outersole. These calks provide necessary traction for walking on logs.

It is now common practice to construct an outersole for such boots by soaking a piece of hard leather in water for a long period of time and then driving one-piece metal calks into the leather in a random array. The leather is then allowed to dry and shrink to grip the inserted portions of the calks and hold them securely and irreplaceably. This commonly used sole has numerous disadvantages.

First, suitable leather for constructing such soles is difficult to obtain and is not readily available in most parts of the world. Due to recent changes in hide production technologies, it is anticipated that this material will be in increasingly short supply and of lessening quality.

Second, the best boot sole leather is difficult to work with and cannot be readily worked without an advanced period of soaking. The insulation of calks in such leather is a costly hand operation which requires a substantial amount of manual labor.

Third, a leather sole is absorbent and will stretch if subjected to water over a long period of time. Thus, if the wearer works in or around a log pond or in a wet area of the forest, the leather can become saturated and its gripping power on the calks reduced. With the sole wet, the calks become loose and have a tendency to pull out.

Fourth, because suitable leather is a very hard material and because the calks are typically spaced in a random array, all portions of the outersole are very inflexible. When working on uneven terrain, the rigid sole forces the wearer to walk uncomfortably on the sides of his feet. Even walking on level terrain is overly difficult as there is no flexibility in the ball portion of the outer sole. As a further result, unnecessary foot ailments develop; and the boots wear down unevenly and excessively.

Fifth, because leather outer soles wear unevenly and because their calks are not replaceable, an entire sole must be replaced when only a few calks or a small area of the outersole is worn.

Sixth, the ball portion of standard calked outersoles tends to clog with mud and bark because the sole is inflexible.

Seventh, the calks driven into a leather outersole extend through the sole creating a bumpy upper surface which is an uneven platform for the wearer's foot. Extra thicknesses of insole material are required to enhance the comfort of such soles.

Eighth, the calks of standard boots resemble straight-shanked nails which are somewhat wobbly because they have no support structure suitable to maintain them perpendicular to the outersole.

SUMMARY OF THE INVENTION

An important feature of the present invention is an outersole which eliminates the above and other difficulties of the prior art. The sole is preferably made of a readily available, flexible synthetic plastic or rubber material and includes a number of calk-receiving receptacles permanently imbedded therein at the time the sole is machine manufactured. These receptacles receive replaceable calks which may be easily removed when they wear out.

Because it includes receptacles that are moulded in, instead of calks which are driven through, the outersole of the present invention has an upper surface which is not bumpy and requires no extra padding. A preferred calk includes an annular flange which rests against the lower surface of the outersole to stabilize the calk and reduce wobble.

To facilitate walking and to eliminate unnecessary wear and foot injuries, receptacles which are located beneath the ball of the wearer's foot are arranged in rows, each of which is parallel to a line through the metatarsal phalangeal joints of the wearer's foot. The rows are spaced apart a sufficient distance that an uninterrupted, straight, lateral area of outer sole material extends between the adjacent rows. With this arrangement, the ball portion of the outer sole is longitudinally flexible along the axis which is normal to the rows of bone joints in the wearer's foot. The ball portion of the sole will thus flex naturally as the wearer walks and will urge the wearer's foot into an orthopedically correct walking alignment. A specific optimum arrangement includes nineteen receptacles arranged in six parallel rows on the ball portion of the outer sole.

An added advantage of having an outer sole with a flexible ball portion is that the calks tend to be self-cleaning since mud separates and falls off the sole as the wearer walks.

It is therefore an object of the present invention to provide an improved work boot with a calked outersole that includes a longitudinally flexible ball portion.

Another object of the invention is to provide such a work boot with sufficient lateral stability to prevent injury to the wearer's foot.

An additional object of the invention is to provide such an improved work boot with calks that are located and shaped to provide a self-cleaning sole which tends not to clog with dirt and bark.

Still another object of the invention is to provide such an improved work boot with an outer sole that can be mass produced and which contains calks which are easily replaced when worn out.

More specific objects of the present invention are to provide such an improved shoe sole with calks located on all downwardly facing surfaces and to locate the calks so that the ball portion of the outersole is longitudinally flexible along an axis which is normal to a line through the metarsal phalangeal joints of the wearer's foot and thereby facilitate orthopedically correct alignment of the wearer's foot during walking.

Yet another object of the present invention is to provide such an improved work boot with calks and calk-receiving receptacles that do not extend above the flat upper surface of the outersole.

These and other objects and advantages of the present invention will be apparent from the following detailed description and from the attached drawing.

BRIEF DESCRIPTION OF THE DRAWING

In the Drawing:

FIG. 1 is a side elevation view of a work boot made in accordance with the present invention;

FIG. 2 is a bottom plan view showing one embodiment of the boot outersole of the present invention;

FIG. 3 is a partial sectional view taken along line 3—3 of FIG. 2;

FIG. 4 is an enlarged portion of FIG. 3; and

FIG. 5 is a partial bottom plan view of the arch portion of another embodiment of the boot outersole of the present invention.

DESCRIPTION OF PREFERRED EMBODIMENTS

As shown in FIG. 1, a work boot made in accordance with the present invention includes a boot upper 10, most preferably made of leather. The upper includes a ball-receiving portion located in the area designated B in FIG. 1, an arch-receiving portion located in the area designated A, and a heel-receiving portion located in the area designated H. A multilayered sole is attached to the bottom of the shoe upper 10 and includes an outer sole 12, a rigid heel wedge 14 and a midsole layer or slipsole 16. The slipsole 16 is jointed to a lasting margin 20 (FIG. 3) which comprises the base of the upper 10. The heel wedge 14 has a flat lower surface 24 and an upper surface secured to the slipsole 16 beneath the heel-receiving portion of the upper.

An elongated steel shank 28 is superposed on the slipsole and extends longitudinally between the arch-receiving and heel-receiving portions of the upper 10 to stabilize the boot. A layer of insole material 30 is present inside the upper 10 to cover the lasting margin 20 and shank 28.

FIG. 2 shows the outersole 12, which is made of a flexible material and which completely covers the bottom of the boot. The outersole has four portions including a heel portion 34 which is located in the area designated H and is secured beneath the heel wedge 14. A heel face portion 36 and an arch portion 38 are located beneath the arch receiving portion of the upper 10 in the area designated A; and a ball portion 40 is located beneath the ball receiving portion of the upper 10 in the area designated B. This entire outersole 12 preferably comprises a single piece of resilient material so that the outersole 12 and the heel wedge 14 together comprise a spring heel. Each of the outersole portions has a flat upper surface which abuts a surface of the slipsole 16 or heel wedge 14.

Thirty-two to thirty-four calk receiving receptacles 44 are imbedded in the outersole 12 as shown in FIGS. 3 and 4. Because the receptacles are molded in when the outersole is formed, no portion of a receptacle 44 extends above the flat upper surface of the outersole 12. The receptacles 44 thus do not cause bulges or lumps in the slipsole 16 which might irritate the foot of the wearer. Each of the receptacles receives a replaceable pointed metal calk 46.

The preferred calks each include an insert portion 50 such as the threaded shaft of the illustrated calks 46. The illustrated insert portion is received by an internally threaded opening in a receptacle 44. Each calk also includes a shank portion 52, preferably made of tungsten steel, which extends downwardly from the insert portion and which terminates at a sharp point. An annular flange 56 extends around the junction of the insert and shank portions 50, 52 and has a diameter which is greater than the length of the shank portion 52. When a calk 46 is installed, its flange 56 is positioned against the lower surface of the outersole portion 12 to stabilize the calk and prevent it from being pryed out of the sole by lateral forces exerted on the shank portion as the wearer walks. A flange 58 on the receptacle 44 maintains the receptacle inside the outer sole 12 even when substantial lateral forces are applied on the shank portion 52. Such calks easily can be changed by screwing an old calk out of its receptacle and inserting a new calk therein.

In order for the boot to be suitable for use in logging and similar activities, the heel portion 34, arch portion 38, and ball portion 40 of the outersole will each contain a plurality of calks; but calks will be absent from the heel face portion 36.

Field tests have shown that the pattern of calks illustrated in FIG. 2 is superior to all others. In this arrangement, nineteen receptacles and calks are located in the ball portion 40 divided among six rows, each of which is parallel to a line L through the metatarsal phalangeal joints of the wearer's foot. More specifically, the line L can comprise a line through the first and fifth metatarsal phalangeal joints of the wearer's foot.

The six rows consecutively include a first row $B_1$, nearest the wearer's toes, containing one receptacle, a second row $B_2$ containing three receptacles, third, fourth and fifth rows $B_3$, $B_4$, $B_5$ containing four receptacles each, and a sixth row $B_6$ which contains three receptacles. These six rows are spaced apart a sufficient distance D that an uninterrupted, straight, lateral area of the flexible outersole material extends between adjacent rows. These lateral areas bend as the wearer walks so the ball portion 40 is longitudinally flexible along an axis X which is normal to the six rows.

To laterally stabilize the ball portion 40 of the flexible outersole 12, the receptacles within any one of the six rows $B_1$–$B_6$ are staggered in relation to receptacles in the other rows so that the ball portion 40 contains no uninterrupted, straight, longitudinal areas or straight longitudinal rows of receptacles. Because there are no straight longitudinal areas that readily bend, the ball portion 40 is substantially laterally inflexible.

Nine of the receptacles 44 and calks 46 are located in the heel portion 34 of the outersole. The receptacles are arranged in four lateral rows which consecutively comprise a first row $H_1$, nearest the wearer's heel, containing one receptacle, a second row $H_2$ containing two receptacles, and third and fourth rows, $H_3$, $H_4$ containing three receptacles each. The lower surface of the installed heel portion 34 of the outersole 12 is substantially planar so that the points of all calks located in the rows $H_1$–$H_4$ substantially lie in a plane and thus provide a flat, inflexible ground-contacting surface beneath the wearer's heel. The outermost receptacles in each of the rows $H_1$–$H_4$ are located adjacent the perimeter of the heel portion 34 to inhibit rocking of the wearer's heel.

The remaining receptacles and calks are located in the arch portion 38 of the outersole 12. These are arranged in multiple lateral rows which contain two receptacles each. As shown in FIG. 2, a normal arch portion 38 will include two rows $A_1$, $A_2$. If the boot is of a large size, an additional row $A_3$ can be included in the arch portion 38 as shown in FIG. 5. In either construction, the calk pattern of the arch portion 38 will be substantially longitudinally symmetrical with both calks in a given row being substantially equally distant from their respective adjacent edges of the outersole 12. This is to keep the boot level when the wearer is standing with his weight on calks located in the arch portion 38.

Because the lower surface of the arch portion 38 is not necessarily planar, rocking is further inhibited by limiting the number of calks in each of the rows $A_1$–$A_3$ to two. It is not advantageous to align the rows $A_1$–$A_3$ with the line L since the arc and heel portions 38, 34 are supported by the shank 28 and are thus substantially longitudinally inflexible.

A boot with an outersole having the above described calk pattern will be orthopedically correct. It will not rock appreciably and will have a sole that will only flex in directions that conform to the natural flection of the wearer's foot. This will encourage the wearer to walk straight and not on the inside of his foot as is the tendency when a sole is completely inflexible.

An added benefit of the above described calk pattern is that the outersoles tend to be self-cleaning. When the wearer walks, the ball portion 40 bends causing mud and bark trapped between the calks to slough off. Also, because there are fewer calks in this pattern than in most prior art logging boots, the calks are spaced further apart and are less likely to clog in the first place.

The outer sole 12 can be a completely planar member which is first bent during installation on the boot to provide the heel face portion 36 which conforms to the heel wedge 14. When, however, the outersole 12 is made of a synthetic material, it can be formed with bends at appropriate locations to define the heel face portion 36 before installation. It would be possible to use a separate piece of outersole material to form the heel portion 34 and thereby eliminate the heel face portion 36. This is not preferred, however, since the wearer is far less likely to accidently kick off a heel wedge if the outersole 12 is one continuous piece.

As will be understood from the above discussion, the outersole 12 could be made from any of several moldable materials. Any of the synthetic plastics or rubbers could be used provided that the selected material is flexible, durable and sufficiently strong to retain the receptacles 44 without any portion of the receptacles extending above the upper surface of the outersole. The most preferred substance would be a moldable synthetic rubber which is hard, but flexible.

It will be apparent to those having ordinary skill in the art that many changes may be made in the details of the above described preferred embodiments without departing from the spirit and scope of the present invention. Therefore, the scope of the present invention should be determined from the following claims.

I claim:

1. A work boot suitable for use on uneven surfaces comprising:

a boot upper having a lasting margin and including ball-receiving, arch-receiving and heel-receiving portions;

a rigid heel wedge secured beneath the heel-receiving portion of the upper;

an outersole of resilient sheet material, the outersole including:

a. a heel portion secured beneath the heel wedge, b. a ball portion secured beneath the ball-receiving portion of the upper, and c. an arch portion secured beneath the arch-receiving portion of the upper; and a plurality of metal calk means located in each portion of the outersole, a part of each calk means being imbedded in the resilient sheet material;

a number of the calk means located in the ball portion of the outersole being in lateral rows consecutively including:

a. a first row, near the wearer's toes, containing at least one calk means, and b. multiple, additional rows each containing at least three calk means, the rows being spaced apart a sufficient distance that an uninterrupted, substantially straight, flexible band of the resilient sheet material extends transversely across the entire width of the outersole, substantially parallel to a line through the metatarsal phalangeal joints of the wearer's foot, between the imbedded parts of the calk means of adjacent rows so that the outersole is longitudinally flexible along an axis which is normal to the bands in a region defined by the rows to urge the wearer's foot to move orthopedically correctly.

2. The work book of claim 1 wherein each calk means comprises:

a calk-receiving receptacle molded into the outersole; and a pointed metal calk removably secured in the receptacle.

3. The work boot of claim 1 wherein the outersole has a flat upper surface and none of the calk means extends above the upper surface.

4. The work boot of claim 1 wherein the calk means in the ball portion of the outersole are arranged in six rows which consecutively comprise:

a first row nearest the wearer's toes, containing one calk means;

a second row containing three calk means;

third, fourth and fifth rows containing four calk means each; and a sixth row containing three calk means.

5. The work boot of claim 1 wherein nine of the calk means are located in the heel portion of the outersole.

6. The work boot of claim 5 wherein the calk means in the heel portion of the outersole are arranged in four lateral rows which consecutively comprise:

a first row nearest the wearer's heel, containing one calk means;

a second row containing two calk means; and third and fourth rows containing three calk means each.

7. The work boot of claim 1 wherein at least four and not more than six of the calk means are located in the arch portion of the outersole.

8. The work boot of claim 7 wherein the calk means in the arch portion of the outersole are arranged in a plurality of lateral rows which contain at least two calk means each.

9. The work boot of claim 1 wherein the calk means within anyone of the rows are staggered in relation to calk means in other rows so that the ball portion of the outer sole is substantially laterally inflexible since it contains no uninterrupted straight longitudinal areas or straight longitudinal rows of calk means.

10. A work boot comprising:

a boot upper having a lasting margin and including ball-receiving, arch-receiving and heel-receiving portions;

a flexible slip sole secured to the lasting margin;

a rigid heel wedge having a flat lower surface and an upper surface secured to the slip sole beneath the heel-receiving portion of the upper;

an elongated steel shank superposed on said slip sole and extending longitudinally beneath said arch-receiving and heel-receiving portions of said upper to stabilize the boot;

a one-piece flexible outersole including:

a. a heel portion with a flat upper surface secured beneath the heel wedge;

b. a ball portion with a flat upper surface secured beneath the portion of the slip sole which is located beneath the ball-receiving portion of the upper, and c. an arch portion with a flat upper surface secured beneath the portion of the slip sole which is located beneath the arch-receiving portion of the upper;

at least thirty-two and not more than thirty-four calk-receiving receptacles imbedded in the outersole with no portion of the receptacles extending above the flat upper surfaces; and a number of pointed metal calks which is equal to the number of receptacles, one of the calks being removably secured in each of the receptacles;

nineteen of the receptacles being located in the ball portion of the outersole in six rows, each of which is parallel to a line through the metatarsal phalangeal joints of the wearer's foot, the six rows consecutively including:

a. a first row, nearest the wearer's toes, containing one receptacle, b. a second row containing three receptacles, c. third, fourth and fifth rows containing four receptacles each, and d. a sixth row containing three receptacles, the six rows being spaced apart a sufficient distance that an uninterrupted, straight, lateral area of the outersole extends between adjacent rows so that the ball portion of the outersole is longitudinally flexible along an axis which is normal to the six rows, the receptacles within anyone of the six rows being staggered in relation to receptacles in other rows so that the ball portion of the outersole is substantially laterally inflexible since it contains no uninterrupted straight longitudinal areas or straight longitudinal rows of receptacles;

nine of the receptacles being located in the heel portion of said outersole and arranged in four lateral rows which consecutively comprise:

a. a first row, nearest the wearer's heel, containing one receptacle, b. a second row containing two receptacles, and c. third and fourth rows containing three receptacles each;

the remainder of said receptacles being located in the arch portion of the outersole and arranged in a plurality of lateral rows which contain two receptacles each.

11. A one-piece, flexible outersole for a work boot suitable for use on uneven surfaces, comprising:

adjacent, coplanar, flat ball and arch portions;

a flat heel face portion extending from the arch portion;

a flat heel portion extending from the face portion; and a plurality of receptacles imbedded in the outersole, the receptacles each having a downwardly-facing calk-receiving opening;

a number of said receptacles being located in the ball portion in multiple rows each of which is parallel to a line through the metatarsal phalangeal joints of the wearer's foot, said rows being spaced apart a sufficient distance that an uninterrupted, straight, lateral area of the outersole extends between adjacent rows so that the ball portion is longitudinally flexible along an axis which is normal to the rows, the receptacles within any one of the rows being staggered in relation to receptacles in all other rows so that the ball portion is substantially laterally inflexible since it contains no uninterrupted, straight longitudinal areas or straight longitudinal rows of receptacles;

a number of the receptacles being located in the heel portion;

a number of the receptacles being located in the arch portion.

12. The sole of claim 11 wherein:

the ball, arch and heel portions have flat upper surfaces; and none of the receptacles extends above the upper surfaces.

13. A one-piece resilient outersole for a work boot, said outersole having parallel upper and lower surfaces and comprising:

adjacent, coplanar, flat ball and arch portions;

a flat heel face portion depending from the arch portion;

a flat heel portion extending from the bottom of said face portion in offset parallel relation to said arch portion; and at least thirty-two and not more than thirty-four receptacles imbedded in the outersole with no portion of the receptacles extending above the upper surface of the outersole, the receptacles each having a downwardly-facing, calk-receiving opening;

nineteen of the receptacles being located in the ball portion in six rows, each of which is parallel to a line through the metatarsal phalangeal joints of the wearer's foot, the six rows consecutively including:

a. a first row, nearest the wearer's toes, containing one receptacle, b. a second row containing three receptacles, c. third, fourth and fifth rows containing four receptacles each, and d. a sixth row containing three receptacles, the six rows being spaced apart a sufficient distance that an uninterrupted, straight, lateral area of the outersole extends between adjacent rows so that the ball portion is longitudinally flexible along an axis which is normal to the six rows, the receptacles within any one of the six rows being staggered in relation to receptacles in all other rows so that the ball portion is substantially laterally inflexible since it contains no uninterrupted, straight longitudinal areas or straight longitudinal rows of receptacles;

nine of the receptacles being located in the heel portion and arranged in four lateral rows which consecutively comprise:

a. a first row, nearest the wearer's heel containing one receptacle, b. a second row containing two receptacles, and c. third and fourth rows containing three receptacles each;

the remainder of the receptacles being located in the arch portion and arranged in a plurality of lateral rows which contain two receptacles each.

14. A work boot suitable for use on uneven surfaces, comprising:

a boot upper having a lasting margin and including ball-receiving and arch-receiving and heel-receiving portions;

a rigid heel wedge secured beneath the heel-receiving portion of the upper;

a resilient outersole, the outersole including:

a. a heel portion secured beneath the heel wedge, b. a ball portion secured beneath the ball-receiving portion of the upper, and c. an arch portion secured beneath the arch-receiving portion of the upper; and a plurality of metal calk means imbedded in the outersole and arranged in at least twelve and not more than thirteen lateral rows;

a number of the calk means being located in the ball portion of the outersole in multiple rows, each of which is parallel to a line through the metatarsal phalangeal joints of the wearer's foot, the rows being spaced apart a sufficient distance that an uninterrupted straight, lateral area of the outersole extends between adjacent rows so that the ball portion of the outersole is longitudinally flexible along an axis which is normal to the rows;

a number of the calk means being located in the heel portions of said outersole;

the remainder of the calk means being located in the arch portion of the outersole.

15. A work boot suitable for use on uneven surfaces, comprising:

a boot upper having a lasting margin and including ball-receiving, arch-receiving and heel-receiving portions;

a flexible slip sole secured to the lasting margin;

a rigid heel wedge having a flat lower surface and an upper surface secured to the slip sole beneath the heel-receiving portion of the upper;

an elongated steel shank superposed on the slip sole and extending longitudinally beneath the arch-receiving and heel-receiving portions of the upper to stabilize the boot;

a flexible outersole including:

a. a heel portion with a flat upper surface secured beneath the heel wedge, b. a ball portion with a flat upper surface secured beneath the portion of the slip sole which is located beneath the ball-receiving portion of the upper, and c. an arch portion with a flat upper surface secured beneath the portion of the slip sole which is located beneath the arch-receiving portion of the upper;

a plurality of calk-receiving receptacles imbedded in the outersole and arranged in at least twelve and not more than thirteen lateral rows; and a number of pointed metal calks which is equal to the number of receptacles, one of the calks being removably secured in each of the receptacles;

the receptacles located in the ball portion of the outersole being arranged in six rows, each of which is substantially parallel to a line through the metatarsal phalangeal joints of the wearer's foot, the six rows consecutively including:

a. a first row, nearest the wearer's toes, containing at least one receptacle, and b. second, third, fourth, fifth and sixth rows each containing at least three receptacles, the six rows being spaced apart a sufficient distance that an uninterrupted, straight, lateral area of the outersole extends between adjacent rows so that the ball portion of the outersole is longitudinally flexible along an axis which is normal to the six rows;

the receptacles located in the heel portion of the outersole and arranged in four lateral rows, at least three of which include a plurality of receptacles;

the remainder of the receptacles being located in the arch portion of the outersole and arranged in a plurality of lateral rows which contain two receptacles each.

16. An outersole for a work boot, said outersole being made of resilient sheet material having parallel upper and lower surfaces and comprising:

adjacent, coplanar, flat ball and arch portions;

a flat heel face portion depending from the arch portion;

a flat heel portion extending from the bottom of said face portion in offset parallel relation to said arch portion; and a plurality of receptacles imbedded in the outersole, the receptacles each having a downwardly-facing, calk-receiving opening;

the receptacles located in the ball portion being arranged in six rows consecutively including:

a. a first row, near the wearer's toes, containing at least one receptacle, and b. second, third, fourth, fifth and sixth rows each containing at least three receptacles, the six rows being spaced apart a sufficient distance that an uninterrupted, substantially straight, flexible band of the resilient sheet material extends transversely across the entire width of the outersole, substantially parallel to a line through the metatarsal phalangeal joints of the wearer's foot, between the imbedded portions of the calk means of adjacent rows so that the ball portion is longitudinally flexible along an axis which is normal to the bands to urge the wearer's foot to move orthopedically correctly;

the receptacles located in the heel portion being arranged in four lateral rows, at least three of which include a plurality of receptacles;

the remainder of the receptacles being located in the arch portion and arranged in a plurality of lateral rows which contain two receptacles each.

17. A work boot suitable for use on uneven surfaces comprising:

a boot upper having a lasting margin and including ball-receiving, arch-receiving and heel-receiving portions;

a rigid heel wedge secured beneath the heel-receiving portion of the upper;

an outersole of resilient sheet material, the outersole including:

a. a heel portion secured beneath the heel wedge;

b. A ball portion secured beneath the ball-receiving portion of the upper, and c. an elevated arch portion secured beneath the arch-receiving portion of the upper; and a plurality of metal calk means located in each portion of the outersole, a part of each calk means being imbedded in the resilient sheet material;

a number of the calk means located in the ball portion of the outersole in an arrangement consisting of six rows spaced apart a sufficient distance that an uninterrupted, substantially straight, flexible band of the resilient sheet material extends transversely across the entire width of the outersole, substantially parallel to a line through the metatarsal phalangeal joints of the wearer's foot, between the imbedded parts of the calk means of adjacent rows so that the outersole is longitudinally flexible along an axis which is normal to the bands to urge the wearer's foot to move orthopedicaly correctly.

* * * * *